US007028781B2

(12) United States Patent
Hill

(10) Patent No.: US 7,028,781 B2
(45) Date of Patent: Apr. 18, 2006

(54) DEEP-WELL, CONTINUOUS-COILED-TUBING APPARATUS AND METHOD OF USE

(76) Inventor: Gilman A. Hill, 7128 S. Poplar La., Englewood, CO (US) 80112

( * ) Notice: Subject to any disclaimer, the term of this patent is extended or adjusted under 35 U.S.C. 154(b) by 0 days.

(21) Appl. No.: 10/925,770

(22) Filed: Aug. 24, 2004

(65) Prior Publication Data

US 2005/0023404 A1 Feb. 3, 2005

Related U.S. Application Data

(62) Division of application No. 10/546,003, filed on Jun. 6, 2003, now abandoned.

(60) Provisional application No. 60/387,073, filed on Jun. 6, 2002.

(51) Int. Cl.
*E21B 19/22* (2006.01)

(52) U.S. Cl. ..... 166/384; 166/77.2; 242/118.41; 242/557; 242/603

(58) Field of Classification Search ..... 166/381, 166/384, 77.1, 77.2, 77.3, 77.4, 77.51, 78.1; 175/162, 203, 220; 242/602.2, 602.3, 603, 242/614, 614.1, 118.41, 118.6, 476.4, 557
See application file for complete search history.

(56) References Cited

U.S. PATENT DOCUMENTS

| | | | | |
|---|---|---|---|---|
| 629,115 | A | 7/1899 | Turney | |
| 1,621,714 | A | 3/1927 | Dyer et al. | |
| 1,626,322 | A | 4/1927 | Bell | |
| 1,689,016 | A | 10/1928 | Erlewine | |
| 2,143,734 | A | 1/1939 | Jenkins | 242/117 |
| 2,212,798 | A | 8/1940 | Sole | 242/117 |
| 2,272,228 | A | 2/1942 | Thornburg et al. | 242/117 |
| 2,359,211 | A | 9/1944 | Fox | 242/117 |
| 2,958,478 | A * | 11/1960 | Petersen et al. | 242/393 |
| 3,000,588 | A * | 9/1961 | Brady | 242/388.8 |
| 3,559,905 | A * | 2/1971 | Palynchuk | 242/390.5 |
| 3,817,466 | A | 6/1974 | Reynard et al. | 242/54 |
| 3,912,225 | A * | 10/1975 | Earnheart | 254/134.3 R |
| 3,934,854 | A * | 1/1976 | Goode | 254/134.3 R |
| 3,960,340 | A | 6/1976 | Naas | 242/117 |
| 4,071,205 | A | 1/1978 | Wieschel | 242/117 |
| 4,148,445 | A * | 4/1979 | Reynolds et al. | 242/388.7 |

(Continued)

OTHER PUBLICATIONS

Notification of Transmittal of the International Search Report or the Declaration dated May 20, 2004 for International Application No. PCT/US03/17904.

(Continued)

*Primary Examiner*—Jennifer H. Gay
(74) *Attorney, Agent, or Firm*—Sheridan Ross P.C.

(57) ABSTRACT

A system and method for injecting or withdrawing a fluid into or from a well includes an injector vehicle having a longitudinal axis and operable to position tubing into the well. The system also includes a tubing supply vehicle operable to provide the tubing to the injector vehicle for positioning in the well. In one aspect of the invention, the tubing is mounted on at least one spool, wherein the longitudinal axis of the injector vehicle is transverse to an axis of rotation of the spool and transverse to a longitudinal axis of the tubing supply vehicle. In a separate aspect of the invention, a spiral guide is used to transition tubing during spooling and unspooling between a plurality of empty and full spools. In yet a separate aspect of the invention, a spool is vertically adjustable to allow rotation of the spool during spooling and unspooling.

27 Claims, 9 Drawing Sheets

U.S. PATENT DOCUMENTS 4,306,682 A * 12/1981 Toussaint ..... 239/745
4,387,863 A 6/1983 Edmonston et al. ..... 242/118.4
4,454,999 A * 6/1984 Woodruff ..... 242/388.7
4,649,954 A * 3/1987 Dunwoody ..... 137/355.17
4,673,035 A 6/1987 Gipson ..... 166/77
4,945,938 A 8/1990 Ponsford et al. ..... 137/15
5,246,184 A 9/1993 Trewhella, Jr. ..... 242/117
5,289,845 A * 3/1994 Sipos et al. ..... 137/355.27
5,593,101 A 1/1997 Varga ..... 242/25 A
5,735,482 A * 4/1998 Kuzik ..... 242/537
5,890,674 A 4/1999 Major ..... 242/587
6,059,220 A 5/2000 Lassiter ..... 242/557
6,092,765 A * 7/2000 White ..... 244/134 R
6,142,406 A * 11/2000 Newman ..... 242/390.9
6,340,126 B1 1/2002 McAlpine et al. ..... 242/160.2
6,419,424 B1 7/2002 Null et al. ..... 405/174
6,454,014 B1 * 9/2002 Coats et al. ..... 166/384
6,502,641 B1 * 1/2003 Carriere et al. ..... 166/384
6,516,892 B1 * 2/2003 Reilly ..... 166/384
2002/0195255 A1 * 12/2002 Reilly ..... 166/384

OTHER PUBLICATIONS

Pending Claims of Prior Pending U.S. Appl. No. 10/456,003, filed Jun. 6, 2003.

* cited by examiner

DEEP-WELL, CONTINUOUS-COILED-TUBING APPARATUS AND METHOD OF USE

CROSS-REFERENCE TO RELATED APPLICATIONS

This application is a division of U.S. patent application Ser. No. 10/456,003 filed on Jun. 6, 2003 and entitled "DEEP-WELL, CONTINUOUS-COILED-TUBING APPARATUS AND METHOD OF USE", abandoned., which claimed priority from U.S. Provisional Patent Application No. 60/387,073 filed Jun. 6, 2002 entitled "DEEP-WELL, CONTINUOUS-COILED-TUBING OPERATIONS". The entire disclosures of these applications are considered to be part of the disclosure of the present application and are hereby incorporated by reference in their entirety.

FIELD OF THE INVENTION

This invention relates generally to long, continuous tubing or pipe supply installation, and more specifically, to oil and gas well drilling and well servicing operations involving deep, continuous tubing.

BACKGROUND OF THE INVENTION

Oil and gas drilling and production operations involve the deployment of equipment down a borehole having considerable depth. Cost saving techniques include using steel tubing that is extended down the borehole or well casing and using the tubing to pump a variety of different fluids, including drilling mud and pressurized water. Typical equipment currently used to provide the continuous tubing includes a truck and trailer with a single coiled steel tube (also herein referred to as pipe) on a spool having an 8 to 10 foot inside diameter core that is wrapped with the tubing to provide a 14-foot outside diameter, where the spool is about 8 feet in length. However, this spool size and configuration, including current techniques and equipment limitations, prevent providing continuous coil tubing down the borehole or well casing at depths beyond approximately 9,500 feet for 2⅜ inch diameter tubing, or approximately 6,000 feet for 2⅞ inch diameter tubing, because the current equipment and spool configurations are too limiting.

FIG. 1 shows the typical current equipment layout for providing steel tubing down a borehole or well casing. Typically, an injector truck/trailer 10 is situated over a well W. The injector truck/trailer 10 typically includes equipment 12 and has a long edge 14 that is typically situated such that it is substantially parallel to the long edge 16 of a tubing supply truck/trailer 18. For the prior art shown in FIG. 1, the tubing supply truck/trailer 18 is shown to include a cab or truck 20 and a trailer 22. The injector truck/trailer 10 has a longitudinal axis $L_I$—$L_I$ that is substantially parallel to a longitudinal axis $L_T$—$L_T$ of the tubing supply truck/trailer 18. In addition, the longitudinal axis $L_I$—$L_I$ of the injector truck/trailer 10 is oriented such that it is typically aligned with the longitudinal axis $L_T$—$L_T$ of the tubing supply truck/trailer 18.

The tubing supply truck/trailer 18 includes a spool 24 of steel tubing T, where the spool 24 has flanges 26 to laterally confine and support the wound tubing T. The flanges 26 are typically oriented substantially parallel with the long edge 16 of the tubing supply truck/trailer 18. In addition, the spool 24 rotates about an axis A—A that is oriented substantially perpendicular to the long edge 16 of the tubing supply truck/trailer 18, as well as perpendicular to both the longitudinal axis $L_I$—$L_I$ of the injector truck/trailer 10 and the longitudinal axis $L_T$—$L_T$ of the tubing supply truck/trailer 18.

In use, as the tubing T is unwound, it is conveyed off the spool 24 and down the borehole or well W via the injector truck/trailer 10 and the equipment 12 that is located on the injector truck/trailer 10. However, as noted, this setup is substantially limiting in terms of the length of tubing that can be continuously fed down the borehole or well casing. Furthermore, this setup is also limiting because the tubing supply truck/trailer 18 has to be oriented substantially parallel to, and aligned with, the injector truck/trailer 10.

In view of the above, there is a long felt but unsolved need for equipment and methods that avoids the above-mentioned deficiencies and limitations of the prior art and that provides for greater lengths of continuous tubing to deep oil and gas boreholes and well casings.

SUMMARY OF THE INVENTION

The shortcomings of the currently available methods and equipment for providing extended lengths of tubing down a borehole or well casing are overcome by the devices and methods of the present invention. More particularly, the present invention includes an apparatus and configuration for providing significantly longer continuous lengths of tubing down a borehole or casing. For all embodiments presented herein, tubing as defined herein is a continuous, moderately flexible tubing that is preferably made of steel, and possesses mechanical properties such that it may be coiled and uncoiled by repeatedly being wound and unwound around a large diameter spool, and wherein the tubing is capable of being sufficiently straightened between the winding and unwinding steps so that it can be inserted into an oil and/or gas well. In addition, a vehicle as defined herein is a moveable or transportable device, with or without an internal propulsion system (e.g., a truck, tractor, trailer, tracked vehicle, wheeled vehicle, sled, raft, boat, etc., or combinations of these).

In a first preferred embodiment, a single large spool is utilized, about which the steel tubing is wound. The single large spool is oriented with its axis of rotation at least substantially perpendicular (or transverse) to the long edge and longitudinal axis $L_I$—$L_I$ of the injector truck/trailer, but at least substantially parallel to the long edge and longitudinal axis $L_T$—$L_T$ of the tubing supply truck/trailer. Thus, in one aspect of the present invention, a system for injecting or withdrawing a fluid into or from a well is provided, where the system comprises an injector vehicle having a longitudinal center axis, the injector vehicle operable to position moderately flexible tubing into the well and introduce the fluid. The system further comprises a tubing supply vehicle having a longitudinal center axis and operable to provide the moderately flexible tubing to the injector vehicle for positioning in the well, wherein the moderately flexible tubing is mounted on at least one spool, the at least one spool having an axis of rotation, wherein the longitudinal center axis of the injector vehicle is transverse to the axis of rotation of the at least one spool and transverse to the longitudinal center axis of the tubing supply vehicle.

In a second preferred embodiment, a plurality of spools of tubing are interconnected and are oriented in a direction such that their shared and common axis is at least substantially perpendicular (or transverse) to the longitudinal axis of the injector truck/trailer, but parallel to the long edge and longitudinal axis of the tubing supply truck/trailer.

In a separate aspect of this second preferred embodiment, a spiral guide is used between adjacent spools of tubing, wherein the spiral guide allows for the tubing to wind or unwind smoothly in transition between an inner layer of tubing on an empty spool and the outermost layer of tubing on an adjacent full spool, or vice-versa. More particularly, a full spool can have a multiple number of layers of tubing, such as five overlapping layers. Therefore, during the winding process, after a spool is full, a device for transitioning between the outer-most layer of tubing on the full spool and the empty inner core on the empty spool is needed. The spiral guide provides a mechanism for accomplishing this transition. Of course, the spiral guide works in reverse fashion when unwinding the spool. That is, after a first spool is emptied of its tubing, the tubing unwinds around the spiral guide, and in the process, the tubing transitions from the inner core of the empty spool having a relatively small radius of curvature, to the outer-most layer of tubing on the next adjacent full spool, where the outer-most layer of tubing occupies a large radius of curvature relative to the radius of curvature of the inner core of the empty spool. Thus, in one aspect of the present invention, a vehicle for supplying moderately flexible tubing is provided, the vehicle comprising a bed and a spooling assembly located on the bed. The spooling assembly comprises at least one spiral guide member operable to transition spooling and unspooling of the moderately flexible tubing from a first spool to an adjacent second spool of the spooling assembly, the at least one spiral guide member being positioned between the first and second spools.

In a separate aspect of the first and second preferred embodiments, roller bearings are used under the flanges of the spool or spools. The roller bearings allow the spools to be rotated and the weight of the coiled tubing is supported and transmitted through the roller bearings to the truck/trailer body. Roller bearings are also preferably used under the ends of the axle that is used to rotate the spool or spools.

In yet a separate aspect of the present invention, an alternate configuration is used whereby a single large spool is oriented with its axis of rotation at least substantially perpendicular (or transverse) to the longitudinal axis of the injector truck/trailer, and also at least substantially perpendicular (or transverse) to the longitudinal axis of the tubing supply truck/trailer. This separate embodiment utilizes a vertically adjustable or displaceable axis of rotation wherein the spool is lifted during winding and unwinding operations. In a separate aspect of this embodiment, the large spool is transported on a low-boy trailer, thereby providing sufficient clearance for the large single spool to be transported on public roads and highways. Thus, in one aspect of the present invention, a vehicle for supplying moderately flexible tubing is provided, the vehicle comprising a bed and a spooling assembly located on the bed, wherein the spooling assembly is configured to be raised and lowered relative to the bed.

In addition to the above described aspects of the invention, methods of introducing moderately flexible tubing into an oil and/or gas well are also provided. Thus, in one aspect of the present invention, a method for supplying moderately flexible tubing to a well is provided. The method comprises a first step of providing (a) an injector vehicle operable to position moderately flexible tubing into the well, the injector vehicle having a longitudinal center axis, and (b) a tubing supply vehicle having a longitudinal center axis and operable to provide the moderately flexible tubing to the injector vehicle for positioning in the well, wherein the moderately flexible tubing is mounted on at least one spool, the at least one spool having an axis of rotation, wherein the longitudinal center axis of the injector vehicle is transverse to the axis of rotation of the at least one spool and transverse to the longitudinal center axis of the tubing supply vehicle. The method further comprises the steps of unspooling the moderately flexible tubing from the at least one spool, feeding the unspooled moderately flexible tubing to the injector vehicle, and introducing the unspooled moderately flexible tubing into the well.

Further and more specific advantages and features of the invention will become apparent to those skilled in the art from the following detailed description, taken in conjunction with the drawings.

DETAILED DESCRIPTION OF THE INVENTION

Figure 1:
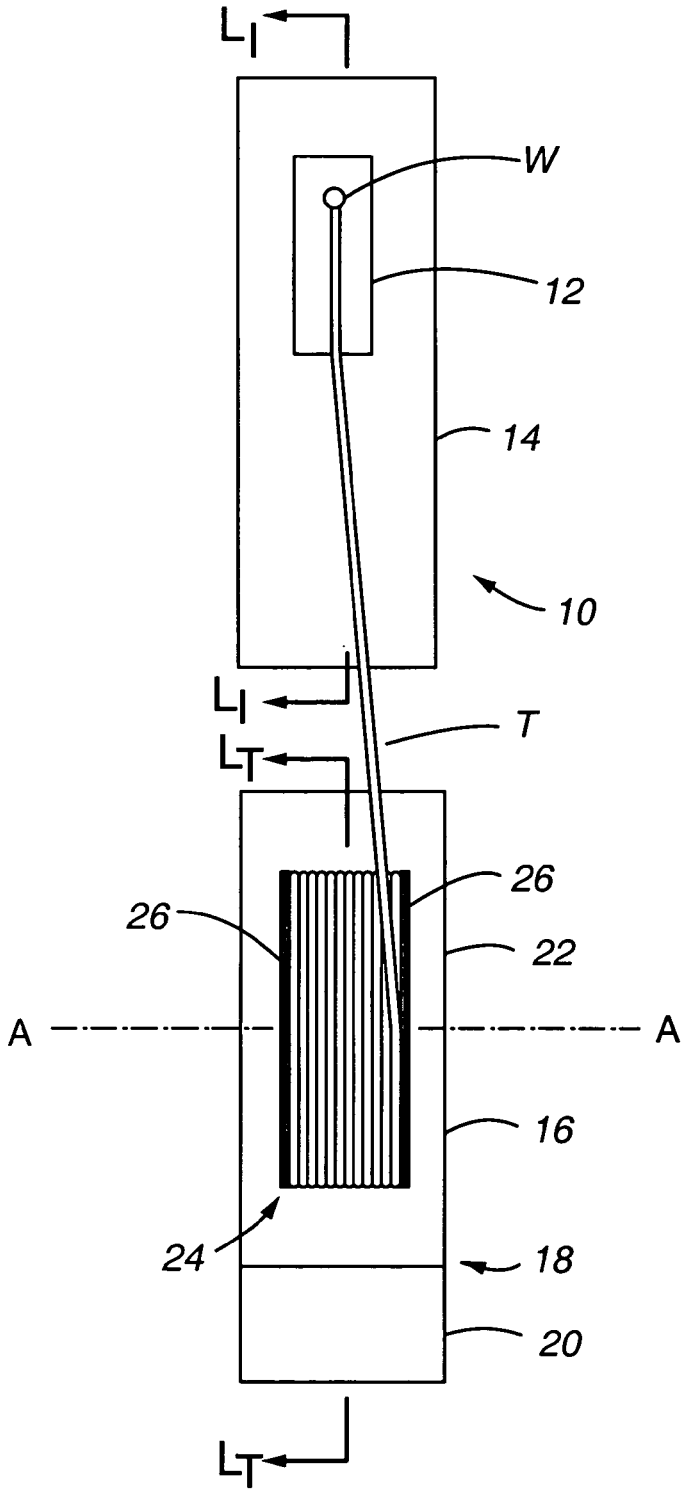
Fig. 1 (PRIOR ART)
FIG. 1 is a plan view showing an equipment configuration of the prior art.
Figure 2:
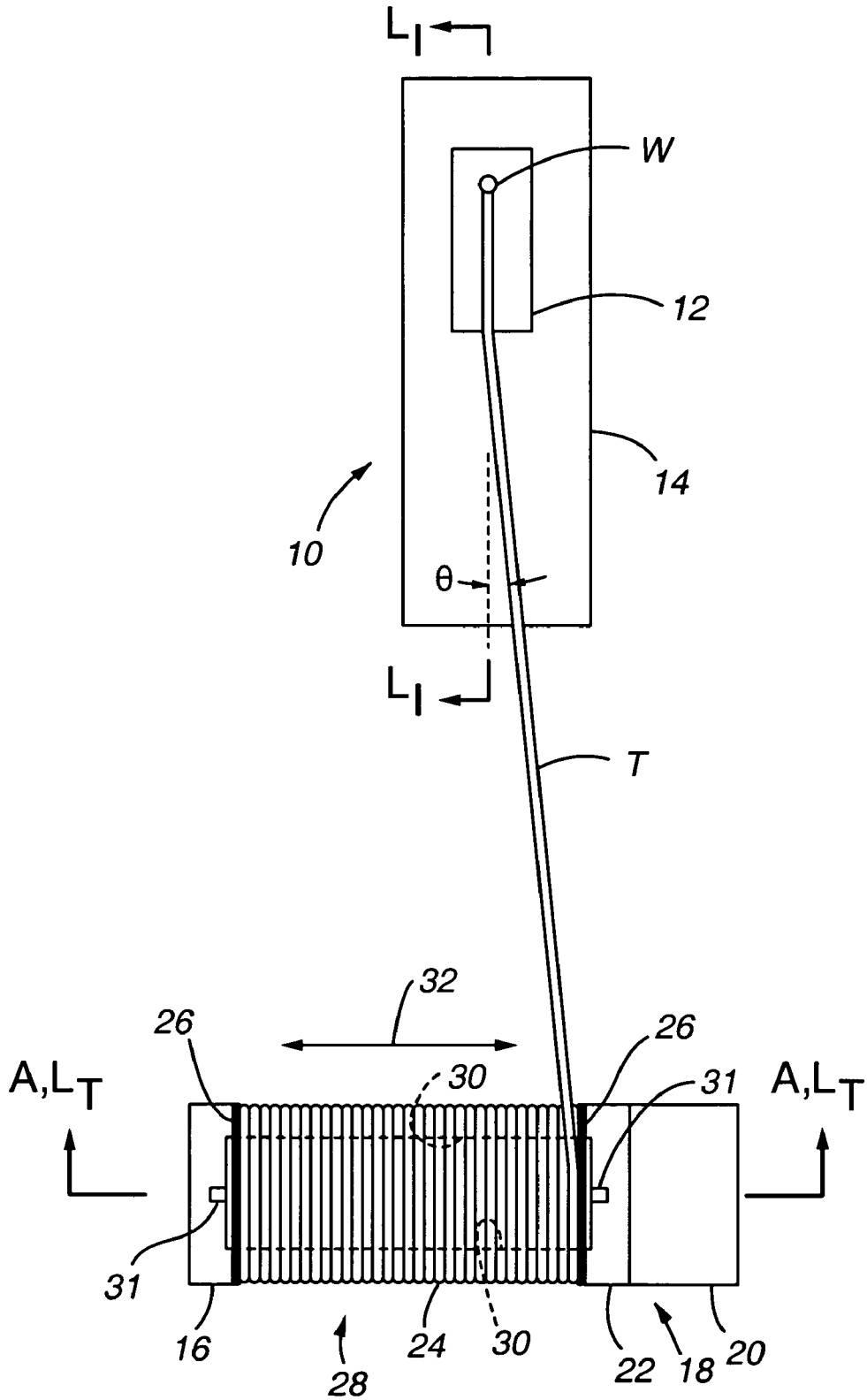
FIG. 2 is a plan view showing an equipment configuration of a first embodiment.

Referring now to FIG. 2, a first embodiment of a deep-well, continuous-coiled-tubing apparatus, or an extended spooling apparatus 28, is shown mounted on a tubing supply truck/trailer 18. The extended spooling apparatus 28 includes a single spool 24 that extends lengthwise along the trailer 22 of the tubing supply truck/trailer 18. The extended spooling apparatus 28 includes an inner core 30 around which the steel tubing T is wound. The inner core 30 has an axis A—A that is aligned substantially parallel to the longitudinal axis $L_T$—$L_T$ of the tubing supply truck/trailer 18. In addition, the inner core 30 and its axis A—A are aligned substantially parallel to the long edge 16 of the tubing supply truck/trailer 18. However, in contrast to the prior art depicted in FIG. 1, the inner core 30 and its axis A—A are aligned substantially perpendicular to the longitudinal axis $L_I$—$L_I$ of the injector truck/trailer 10. In addition, for the extended spooling apparatus 28, the longitudinal axis $L_T$—$L_T$ of the tubing supplytruck/trailer 18 is also substantially perpendicular to the longitudinal axis $L_I$—$L_I$ of the injector truck/trailer 10.

In a separate aspect of extended spooling apparatus 28, inner core 30 may extend longitudinally beyond flanges 26 and act as a drive shaft to rotate spool 24. More particularly, inner core 30 or an axle 31 operatively connected to inner core 30 may extend longitudinally beyond at least one of the two flanges 26 of extended spooling apparatus 28 and be powered by a rotating drive mechanism (not shown), thereby serving to rotate spool 24 for the winding procedure of placing tubing T on the spool 24, and the unwinding procedure of taking it off the spool 24.

In use, the tubing supply truck/trailer 18 is driven to the location of the oil and/or gas well W and its longitudinal axis $L_T$—$L_T$ is situated substantially perpendicular (or transverse) to the longitudinal axis $L_I$—$L_I$ of the injector truck/trailer 10. The tubing T on the tubing supply truck/trailer 18 is then partially unwound and inserted into the well W. To advance the tubing T down the well W, the spool 24 is rotated in a first direction to unwind the tubing T off of the inner core 30. As the tubing T is progressively unwound, an additional optional step includes moving the spool 24 forwards and/or backwards along directional arrow 32 to facilitate allowing the tubing T to unwind off of spool 24 at an orientation that is substantially similar to the longitudinal axis $L_I$—$L_I$ of the injector truck/trailer 10. More particularly, as shown in FIG. 2, as the tubing T approaches the well W at an angle θ, where angle θ is measured positive from either side of the longitudinal axis $L_I$—$L_I$ of the injector truck/trailer 10, then by moving the spool 24 laterally relative to the longitudinal axis $L_I$—$L_I$ of the injector truck/trailer 10 the tubing T is unwound in a smooth fashion, thereby mitigating the risk of stressing or bending the tubing T at the well W or at the spool 24. Moving the spool 24 can be achieved in several ways, including by moving the tubing supply truck/trailer 18 forwards and/or backwards along arrow 32, and/or by moving only the trailer 22 forwards and/or backwards along directional arrow 32, such as by a hydraulic mechanism, and/or by moving the spool 24 on trailer 22 forwards and/or backwards along directional arrow 32, such as by a hydraulic mechanism. Alternatively, a mechanical guide (not shown) may be situated between the spool 24 and the well W, wherein the guide is used to assist in properly orienting the tubing T from the spool 24 to the well W.

Figure 3A:
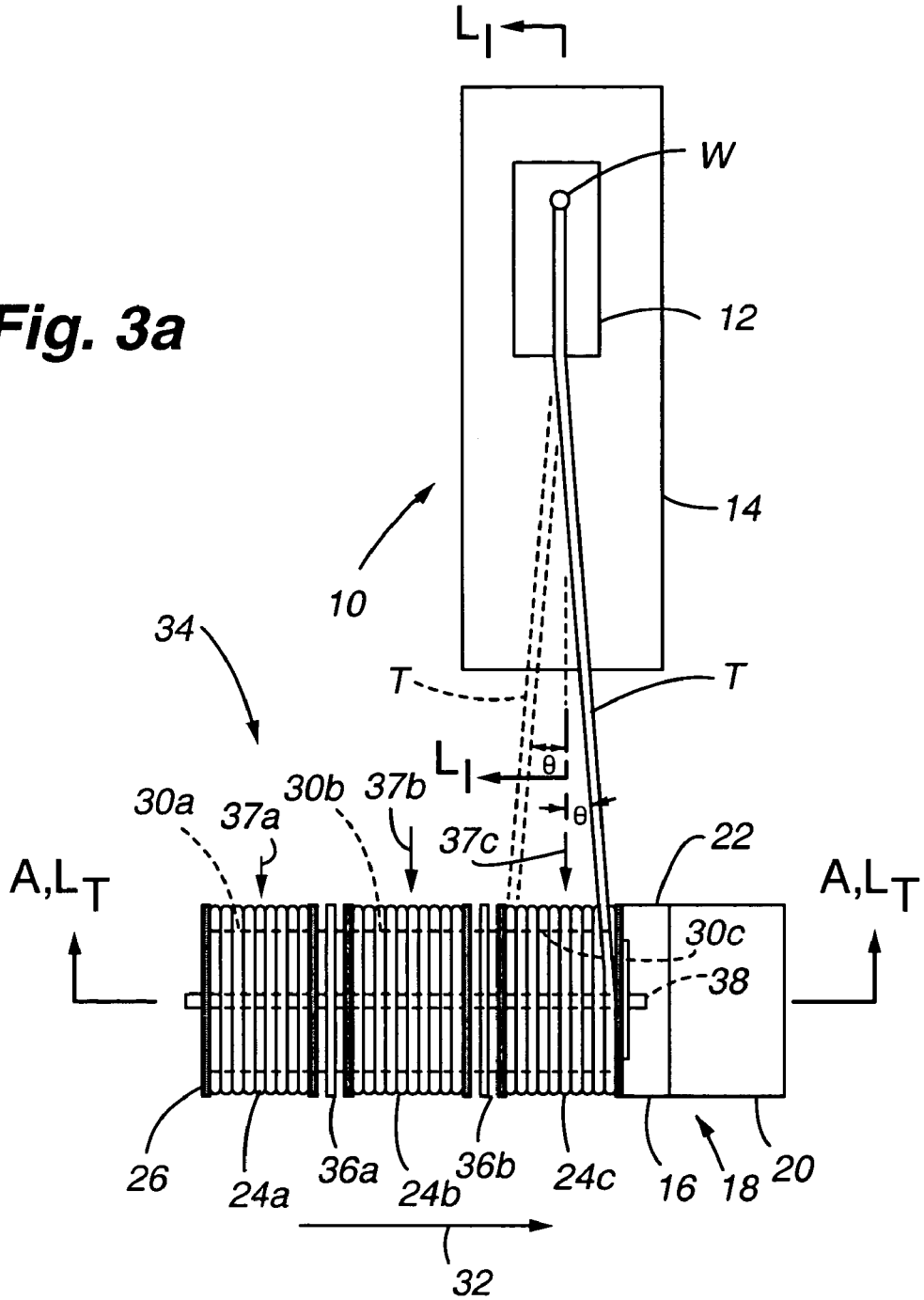
FIG. 3*a* is a plan view showing an equipment configuration of a separate embodiment.
Figure 3B:
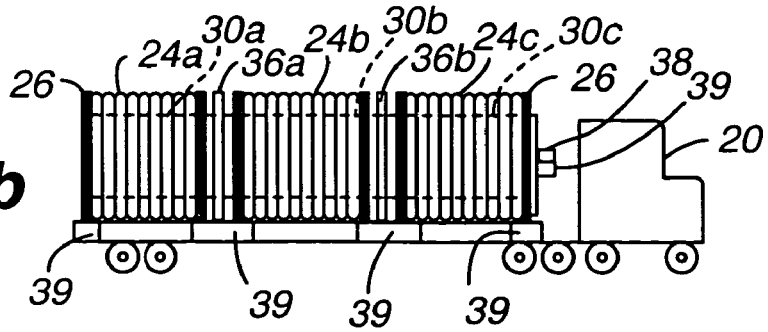
FIG. 3*b* is a side elevation view of the tubing supply truck/trailer shown in FIG. 3*a;*

Referring now to FIGS. 3*a* and 3*b*, a separate preferred embodiment of an extended spooling apparatus 34 is shown. Extended spooling apparatus 34 includes a plurality of spools 24 mounted on the tubing supply truck/trailer 18. The example shown in FIGS. 3*a* and 3*b* of extended spooling apparatus 34 features three spools 24*a–c*. Between spools 24*a* and 24*b*, and between spools 24*b* and 24*c* are spiral guides 36*a* and 36*b*, respectively. Spiral guides 36*a* and 36*b* are used to transition between a full spool and an empty spool when tubing T is being wound onto the extended spooling apparatus 34, or to transition between an empty spool and a full spool when tubing T is being unwound from the extended spooling apparatus 34.

As with extended spooling apparatus 28, extended spooling apparatus 34 includes inner cores 30*a–c* for spools 24*a–c*, respectively, around which the steel tubing T is wound. The spools 24*a–c* have a common (or co-located) rotational axis A—A that is aligned substantially parallel with the longitudinal axis $L_T$—$L_T$ of the tubing supply truck/trailer 18. In addition, spools 24*a–c* and their common axis A—A are aligned substantially parallel to the long edge 16 of the tubing supply truck/trailer 18. However, in contrast to the prior art depicted in FIG. 1, the spools 24*a–c* and their common axis A—A are aligned substantially perpendicular (or transverse) to the longitudinal axis $L_I$—$L_I$ of the injector truck/trailer 10. In addition, for the extended spooling apparatus 34, the longitudinal axis $L_T$—$L_T$ of the tubing supply truck/trailer 18 is also substantially perpendicular to the longitudinal axis $L_I$—$L_I$ of the injector truck/trailer 10.

Figure 4:
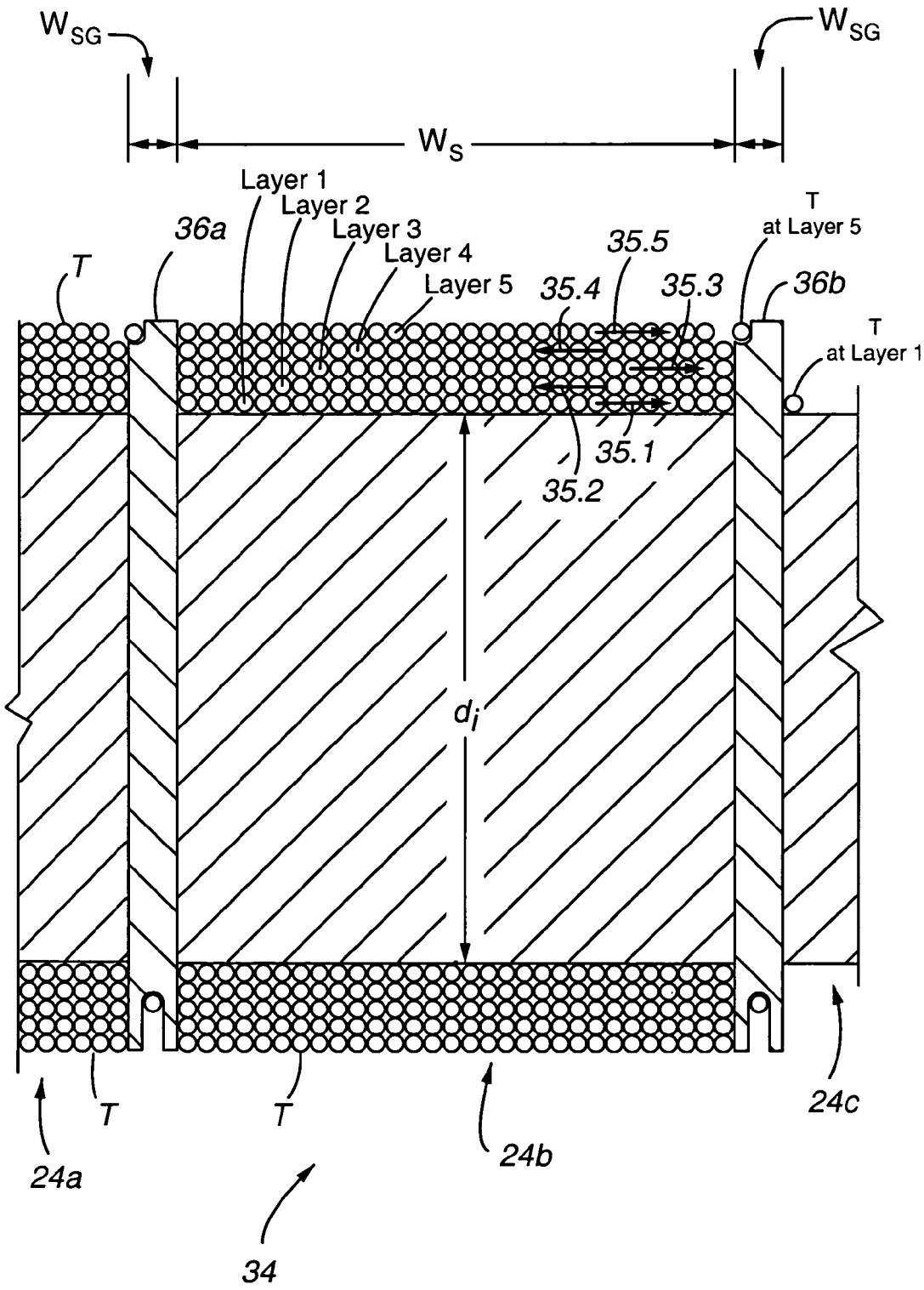
FIG. 4 is cross-sectional view showing a portion of the equipment shown in FIG. 3*b;*

Referring now to FIG. 4, a partial cross-sectional view of the extended spooling apparatus 34 is shown. FIG. 4 illustrates spool 24*b* in the center of the drawing with full spool 24*a* to the left of spool full 24*b*, and with substantially empty spool 24*c* to the right of full spool 24*b*. The number of layers of tubing T wound around a spool 24 can vary depending upon the size of the tubing. For steel tubing having a diameter of 2⅞ inches, preferably about three or five layers of tubing will be wound around each spool. For illustration purposes, and as an example without limitation, FIG. 4 is shown with spools 24*a* and 24*b* having five layers of tubing, and spool 24*c* has only the very beginning of a first layer of tubing T.

For the example shown in FIGS. 3*a*, 3*b* and 4, a typical spool 24*a–c* will have a longitudinal length $W_S$, where $W_S$ is preferably between about 4 to 12 feet long, and more preferably between about 6 to 10 feet long, and more preferably yet, about 8 feet long. Spiral guides 36*a* and 36*b* have a longitudinal length $W_{SG}$, where $W_{SG}$ is preferably between about 0.5 to 2.0 feet long, and more preferably between about 0.6 to 1.5 feet long, and more preferably yet, between about 0.7 to 1.0 feet long.

Still referring to FIG. 4, by way of example and not limitation, for the winding of tubing T onto extended spooling apparatus 34, first spool 24*a* is wound with five layers of tubing T before any tubing is applied to spools 24*b* and 24*c*. After spool 24*a* is filled with five layers of tubing T, spiral guide 36*a* transitions between full spool 24*a* to empty spool 24*b* by providing a spiral path that leads from full spool 24*a* to empty spool 24*b*, as will be discussed below. Upon winding tubing T around spiral guide 36*a*, tubing T is set at a position to begin layer 1 on empty spool 24*b* at the left side of spool 24*b* as shown in FIG. 4. Spool 24*b* is then filled with tubing T by progressively adding layer 1 from left to right, per. FIG. 4, across spool 24*b*. Layer 2 of spool 24*b* is applied by wrapping tubing T around spool 24*b* from right to left, per FIG. 4, after layer 1 is filled. FIG. 4 includes directional arrows 35.1–5 along each layer 1–5, respectively, that show the direction of filling for each layer 1–5. Layers 3 through 5 are filled in a similar fashion as for layers 1 and 2. For the example shown in FIG. 4, layer 5 of tubing is completed at the right end of spool 24*b*. Tubing T then transitions to empty spool 24*c* by transitioning along the spiral path provided by spiral guide 36*b* until tubing T is set at a position to begin layer 1 on empty spool 24*c* at the left side of spool 24*c*, per FIG. 4. Thus, each spiral guide 36*a* and 36*b* provides a transitioning mechanism for altering the position of the tubing from a full spool to an empty spool, or vice-versa.

Figure 5:
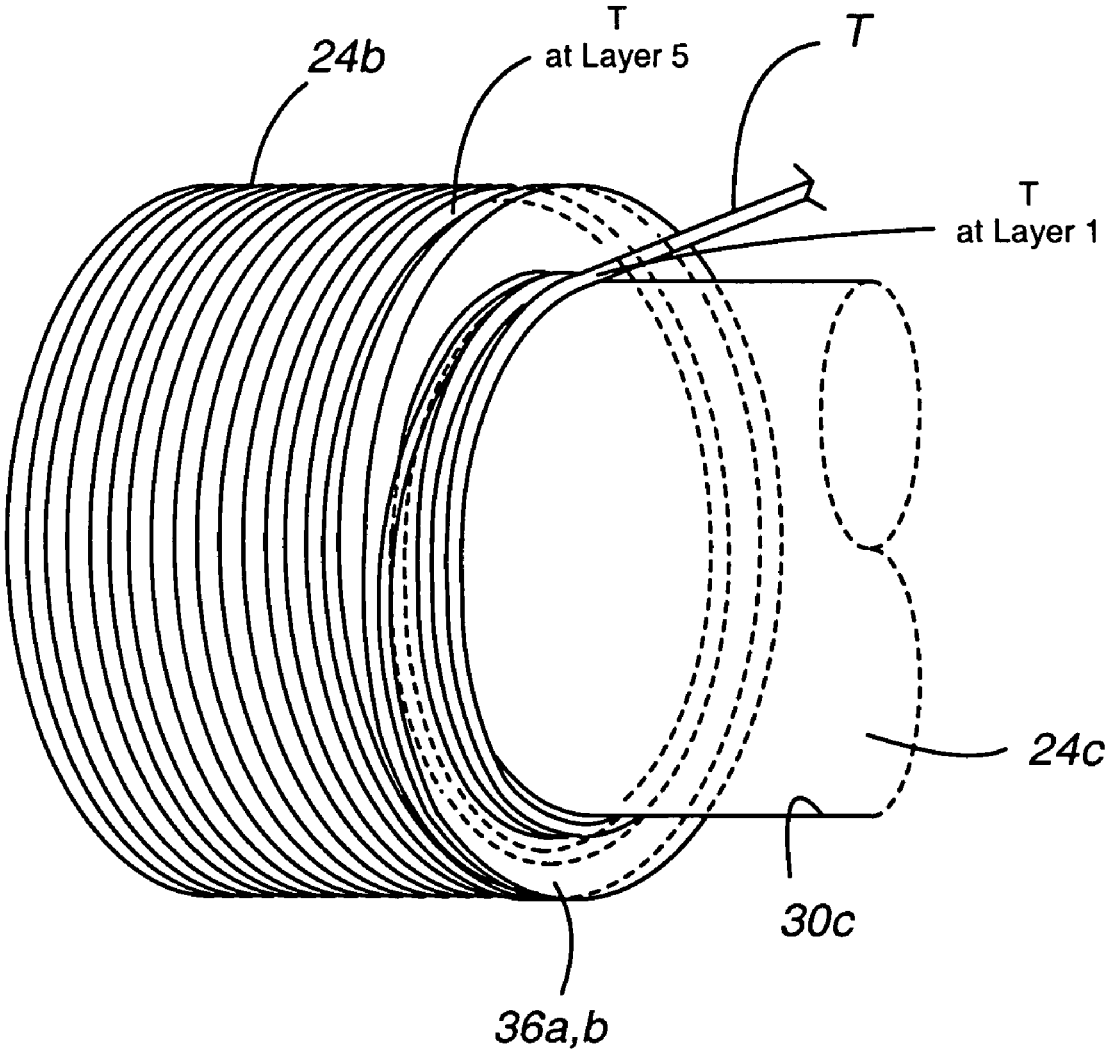
FIG. 5 is an perspective view of a portion of the component depicted in FIG. 4, including a portion of a full spool, a spiral guide, and portion of an empty spool.

Referring now to FIG. 5, a perspective view of a portion of the extended spooling apparatus 34 is illustrated, including full spool 24*b*, spiral guide 36*b* and substantially empty spool 24*c*. Tubing T at layer 5 transitions from spool 24*b* onto spiral guide 36*b* where its winding diameter is modified and reduced along the path of spiral guide 36*b* such that tubing T transitions to layer 1 and forms the first layer on inner core 30*c* of spool 24*c*.

Figure 6:
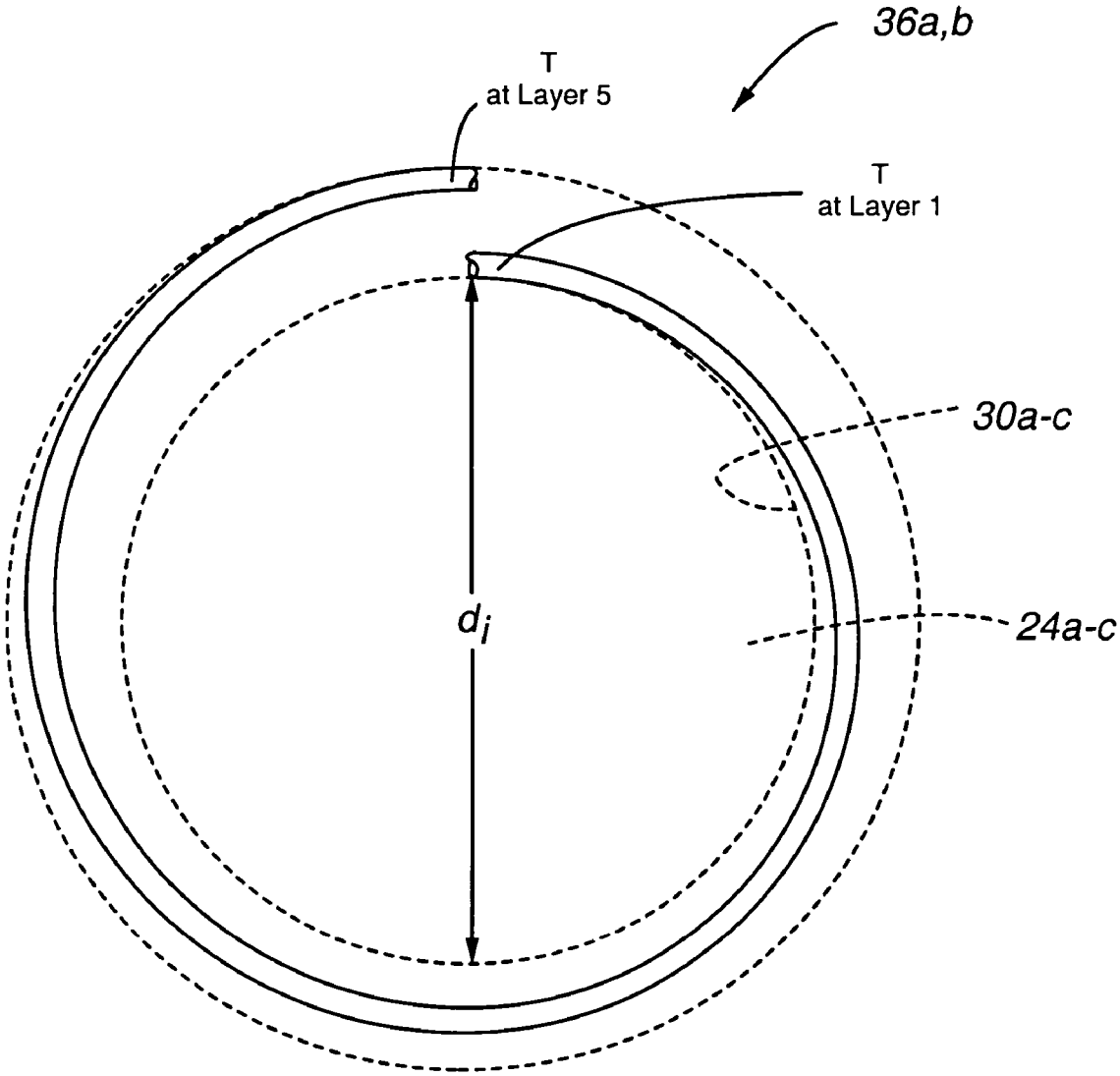
FIG. 6 is a end-on elevation view of a spiral guide portion of the embodiment shown in FIG. 3*a;*
Figure 7:
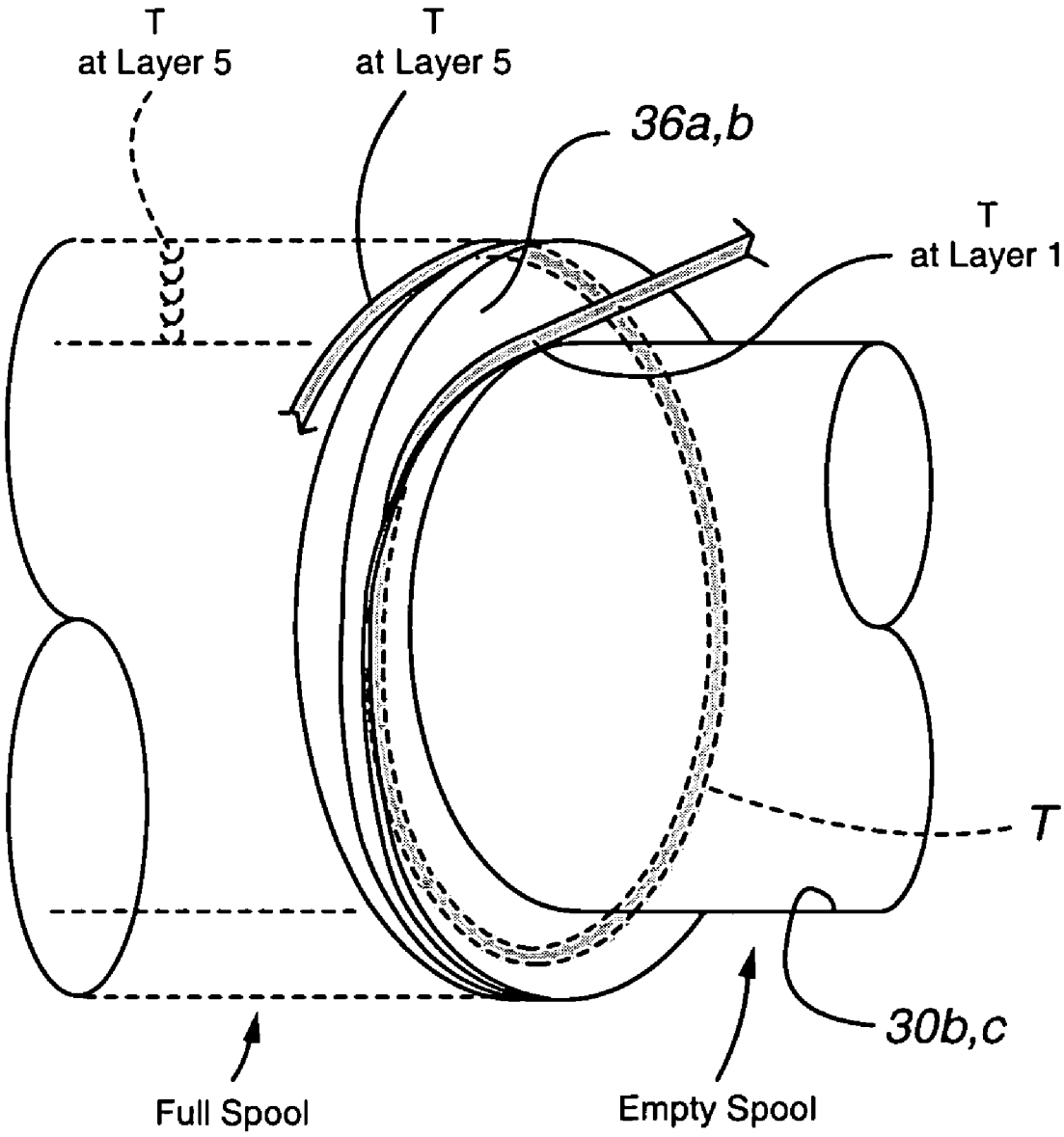
FIG. 7 is a perspective view of the spiral guide shown in FIG. 6, with schematic illustration of the adjacent full and empty spools.

Referring now to FIGS. 6 and 7, the spiral guide 36*b* is shown in a cross-sectional view and a perspective view, respectively. FIGS. 6 and 7 illustrate that the tubing T transitions from a position for layer 5 to a position for layer 1. Although shown to occupy about one revolution around spiral guide 36*a*, 36*b*, the transition from layer 5 to layer 1 may occupy a fraction of a revolution, or it may occupy more than about one revolution. Despite the number of revolutions used, spiral guides 36*a* and 36*b* provide a substantially spiral shaped path for transitioning the radius of curvature of tubing T around axis A—A between spools 24*a–c*.

Still referring to FIG. 6, the interior circular line in phantom corresponds to the inside of spools 24*a–c*, or inner cores 30*a–c*, with inside diameters $d_i$, where $d_i$ can vary depending on the dimensions of the tubing being applied to the spools 24*a–c*. For steel tubing having a diameter of about 2⅞ inches, the inner cores 30*a–c* with an inside diameters $d_i$ are anticipated to be about 8 to 10 feet in diameter. The outer circular line in phantom corresponds to the outside diameter of flanges 26 that form the exterior ends of spools 24*a* and 24*c*. In addition, the outer circular line in phantom generally corresponds to the outside diameter of spiral guides 36*a* and 36*b*, wherein the spiral guides 36*a* and 36*b* themselves serve as flanges to spool 24*b* and the interior ends of spools 24*a* and 24*c*.

In use, the tubing supply truck/trailer 18 is driven to the location of the oil and/or gas well W and situated substantially perpendicular to the injector truck/trailer 10. Preferably, the lateral center 37*c* of spool 24*c* is initially aligned with the longitudinal axis $L_I$—$L_I$ of the injector truck/trailer 10 or the location of well W. The tubing T on the tubing supply truck/trailer 18 is then partially unwound off of full spool 24*c* and inserted into the well W. To advance the tubing T down the well W, the spools 24*a–c* and spiral guides 36*a* and 36*b* are rotated together as one unit in a first direction to unwind the tubing T off of inner core 30*c*. After the tubing T is progressively unwound off of third spool 24*c*, tubing T transitions from layer 1 on empty spool 24*c* to layer 5 on full second spool 24*b* by transitioning its radius of curvature along spiral guide 36*b*. That is, tubing T transitions from layer 1 on spool 24*c* to layer 5 on spool 24*b*. Of course, if spool 24*b* held three layers of tubing, then tubing T would transition from layer 1 on spool 24*c* to layer 3 on spool 24*b*. Tubing T is then progressively unwound off of second spool 24*b*. After the tubing T is progressively unwound off of second spool 24*b*, tubing T transitions from layer 1 on empty spool 24*b* to layer 5 on full first spool 24*a* by transitioning its radius of curvature along spiral guide 36*a*. First spool 24*a* is then progressively unwound until tubing T is emptied off of spool 24*a*, or until the desired depth of insertion is reached.

Additional optional steps include moving the spools 24*a–c* forwards along directional arrow 32 to facilitate allowing the tubing T to unwind off of spool 24*b* and 24*a* at an orientation that is substantially similar to the longitudinal axis $L_I$—$L_I$ of the injector truck/trailer 10. More particularly, as shown in FIG. 3, as the tubing T approaches the well W at an angle θ, where angle θ is measured positive from either side of the longitudinal axis $L_I$—$L_I$ of the injector truck/trailer 10, then by moving the spools 24*b* and 24*a* laterally forward relative to the longitudinal axis $L_I$—$L_I$ of the injector truck/trailer 10, the tubing T is unwound at a low angle θ in a smooth fashion, thereby mitigating the risk of stressing or bending the tubing T at the well W or at the spools 24*b* and 24*a*. Moving the spools 24*b* and 24*a* can be achieved in several ways, including by moving the tubing supply truck/trailer 18 forwards along arrow 32, and/or by moving only the trailer 22 forwards along directional arrow 32, such as by a hydraulic mechanism, and/or by moving the spools 24*a–c* on trailer 22 forwards and/or backwards along directional arrow 32, such as by a hydraulic mechanism. Alternatively, a mechanical guide (not shown) may be situated between the tubing supply truck/trailer 18 and the well W, wherein the guide is used to assist in properly orienting the tubing T from the spools 24*b* and 24*a* to the well W.

Extended spooling apparatus 34 is distinguished over extended spooling apparatus 28 in terms of the frequency in which adjusting the position of the tubing supply truck/trailer 18 relative the injector truck/trailer is performed. More particularly, if the tubing supply truck/trailer 18 is sufficiently distant from the injector truck/trailer 10, for either extended spooling apparatus 28 or extended spooling apparatus 34, adjusting the position of the tubing supply truck/trailer 18 relative to the injector truck/trailer 10 may not be necessary because the angle θ is too small to cause potential damaging stress to tubing T. However, if the tubing supply truck/trailer 18 is close enough to the injector truck/trailer 10 to require adjusting the position of the tubing supply truck/trailer to prevent damaging tubing T during unwinding or winding, then extended spooling apparatus 34 can be adjusted twice by moving the tubing supply truck/trailer 18 forward a first time after unwinding tubing T from spool 24*c* and initiating unwinding at spool 24*b*, and then by moving the tubing supply truck/trailer forward a second time after initiating unwinding at spool 24*a*. For these two adjustments, preferably the lateral centers 37*b* and 37*a* of spools 24*b* and 24*a*, respectively, are adjusted to substantially match the longitudinal axis $L_I$—$L_I$ of injector truck/trailer 10. In contrast to this method, extended spooling apparatus 28 would require adjusting the location of the tubing supply truck/trailer 18 relative to the longitudinal axis $L_I$—$L_I$ of the injector truck/trailer 10 by substantially continuous movement of the single spool 24 forwards and backwards throughout either the unwinding or winding procedure.

Referring again to FIG. 3*a*, in a separate aspect of extended spooling apparatus 34, inner core 30*a* and/or 30*c* may extend longitudinally beyond end flanges 26 and act as a drive shaft to rotate spools 24*a–c*. More particularly, inner core 30*a* and/or 30*c* or an axle type structure, such as axle 38 operatively connected to spools 24*a–c* may extend longitudinally beyond at least one of the two end flanges 26 of extended spooling apparatus 34 and be powered by a rotating drive mechanism (not shown), thereby serving to spin spools 24*a–c* for the winding and unwinding procedure of placing tubing T on the spools 24*a–c* or taking it off the spool 24*a–c*.

Referring again to FIG. 3*b*, in a yet separate aspect of the present invention, roller bearings 39 known to those familiar with the art, are preferably included under the flanges 26 of spool(s) 24 so that the spool(s) 24 can be rotated and the weight of the coiled tubing can be supported and transmitted through the roller bearings to the truck/trailer body. In addition, roller bearings 39 are also preferably included in conjunction with the drive shaft 38 that is used to rotate the spool or spools.

Figure 8:
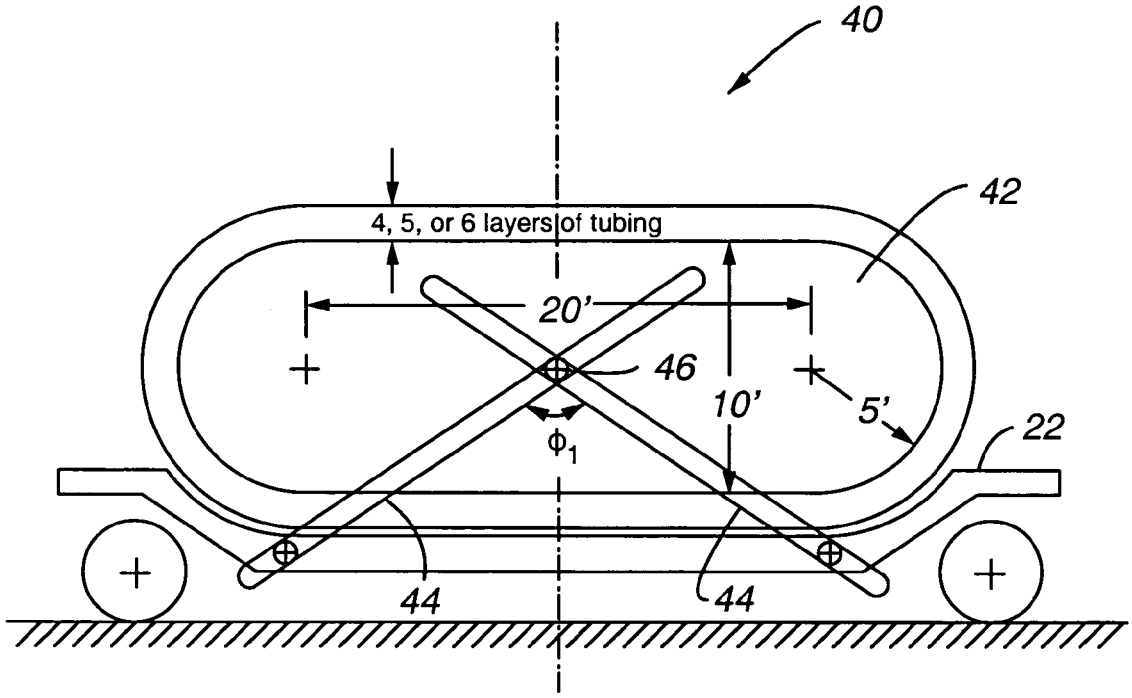
FIGS. 8 and 9 are elevation views of yet a separate embodiment of the present invention.
Figure 9:
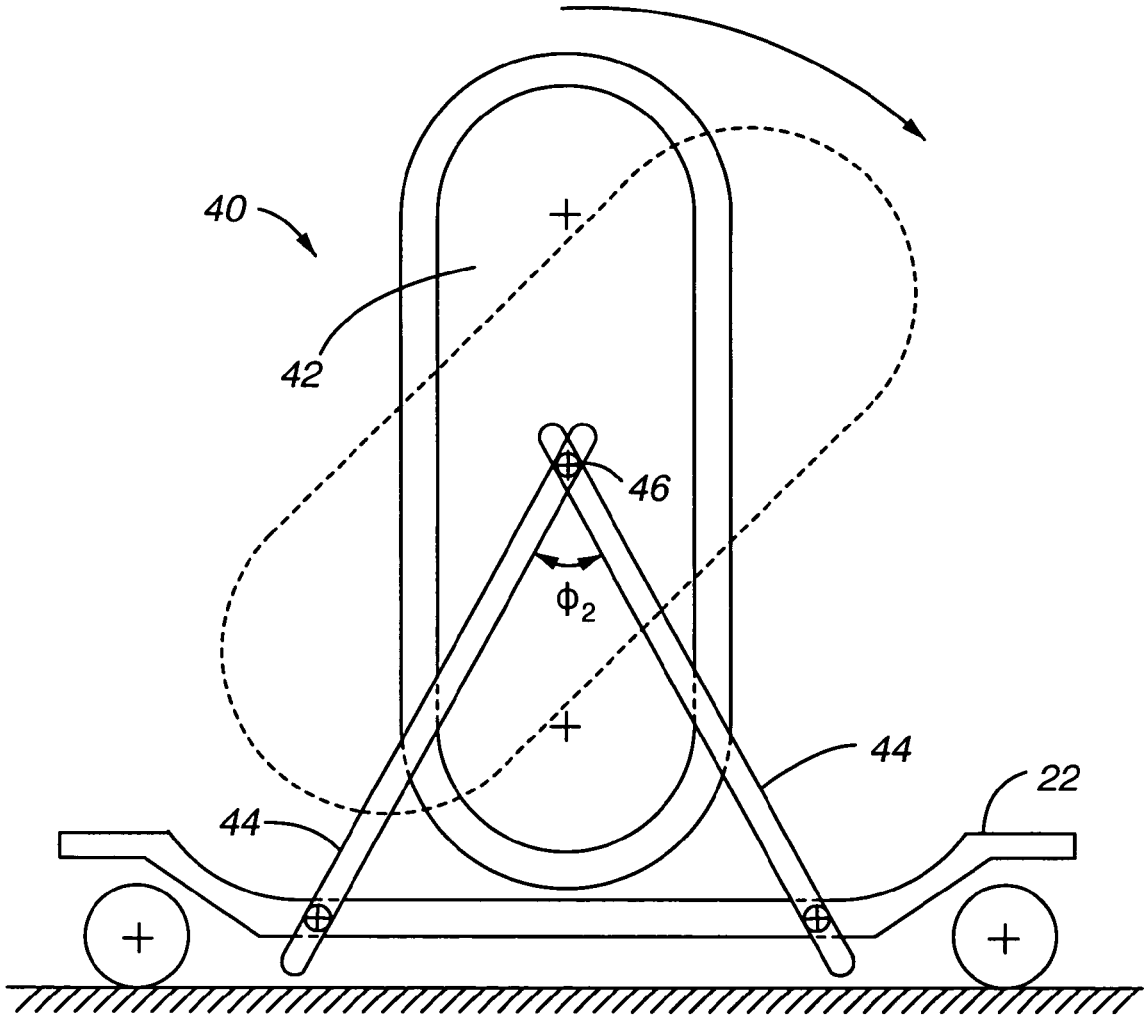

Referring again to FIG. 1, in yet a separate embodiment the equipment configuration of the prior art is applied, but with a modified extended spooling apparatus 40, as shown in elevation view of FIG. 8. Extended spooling apparatus 40 includes a single large spool 42 having an axis A—A that is substantially perpendicular to the longitudinal axis $L_I$—$L_I$ of the injector truck/trailer 10, and is also substantially perpendicular to the long edge 16 of tubing supply truck/trailer 18 and the longitudinal axis $L_T$—$L_T$ of the tubing supply truck/trailer 18. Extended spooling apparatus 40 utilizes a vertically adjustable spool 42 that can be raised and lowered to perform the winding and unwinding operations, as in FIG. 9. Preferably, spool 42 and trailer 22 are interconnected using a pair of elongated supports 44 on each side of the trailer 22. The elongated supports 44 are preferably connected to the rotational axis 46 of spool 42, and allow the spool 42 to be freely rotated when the spool 42 is in its raised position, as in FIG. 9. When in the lowered position, a first angle $\phi_1$ exists between the elongated supports 44. When in the raised position, a second angle $\phi_2$ exists between the elongated supports 44, where angle $\phi_2$ is less than angle $\phi_1$. Preferably, the elongated supports 44 are moveable, and more preferably, the elongated supports 44 are slideable relative to each other, thereby allowing them to be adjusted from a first position corresponding to the lowered spool position, as shown in FIG. 8, to a second position corresponding to the raised spool position, as shown in FIG. 9.

The spool 42 of extended spooling apparatus 40 preferably features two semi-circular end portions having about a 5-foot radius separated by a horizontal distance of about 20 to 30 feet. FIG. 8 illustrates an example of the present embodiment where the inside of the spool 42 has a height of about 10 feet, with two semi-circular end portions having about a 5-foot radius separated by a horizontal distance of about 20 feet. After winding with tubing T, the physical dimensions of the coiled tubing load on the trailer 22 will be about 8 feet wide, 33 feet in longitudinal length, and about 12 to 13 feet high. In use, the longitudinal axis $L_T$—$L_T$ of the tubing supply truck/trailer 18 is positioned to substantially correspond to the longitudinal axis $L_T$—$L_T$ of the injector truck/trailer 10. The spool 42 is then elevated about 12 to 14 feet, as shown in FIG. 9, and then rotated about its axis for unspooling and respooling the tubing about the spool 42.

It is a separate aspect of the invention, extended spooling apparatuses 28, 34, and 40 are used in conjunction with a low-boy trailer to reduce their overall height during transport.

Embodiments of the present invention are anticipated to typically be used with 2⅞ inch diameter steel tubing. However, the present invention may also be used with 1 9/10, 1⅔, 2 1/16, 2⅜, and 2⅝ inch diameter steel tubing. As noted above, the drive shaft for the spools and the flanges of the spools are structurally connected. If the same drive shaft diameter and coiled tubing flange outside diameter are maintained, then longer lengths with more coiled tubing layers can be accommodated for tubing with progressively smaller diameters.

The invention has been described with respect to preferred embodiments; however, other changes and modifications to the invention may be made which are still contemplated within the spirit and scope of the invention.

What is claimed is:

1. A system for injecting or withdrawing a fluid into or from a well, comprising:

(a) an injector vehicle operable to position a flexible tubing into the well, the injector vehicle having a longitudinal center axis; and (b) a tubing supply vehicle having a longitudinal center axis and operable to provide the flexible tubing to the injector vehicle for positioning in the well, wherein the flexible tubing is mounted on at least one spool prior to and for transportation to the well, the at least one spool having an axis of rotation, wherein the longitudinal center axis of the injector vehicle is transverse to the axis of rotation of the at least one spool and transverse to the longitudinal center axis of the tubing supply vehicle, wherein the axis of rotation of the at least one spool is substantially parallel to the longitudinal center axis of the tubing supply vehicle, and wherein the tubing supply vehicle comprises a spool displacement device operable to displace the spool back-and-forth along the longitudinal center axis of the tubing supply vehicle to maintain an angular orientation of the flexible tubing relative to the longitudinal center axis of the injector vehicle at an angle less than a selected angle to inhibit bending of the flexible tubing.

2. The system of claim 1, wherein said at least one spool includes flanges.

3. The system of claim 2, further comprising roller bearings under an outer circumferential edge of said flanges.

4. The system of claim 1, wherein said flexible tubing comprises steel tubing.

5. The system of claim 1, wherein said longitudinal center axis of the tubing supply vehicle is perpendicular to the longitudinal center axis of the injector vehicle.

6. The system of claim 1, wherein the tubing supply vehicle comprises an internal propulsion system.

7. The system of claim 6, wherein said spool displacement device comprises the internal propulsion system.

8. The system of claim 1, wherein said at least one spool is interconnected to an axle positioned within substantially a center of said at least one spool.

9. The system of claim 8, wherein said axle is perpendicular to the longitudinal center axis of the injector vehicle.

10. The system of claim 8, wherein a roller bearing is located proximate at least a first end of said axle.

11. The system of claim 1, wherein said at least one spool comprises an inner core, wherein at least a portion of the flexible tubing is wound around the inner core.

12. The system of claim 1, wherein the spool comprises a plurality of interconnected spool segments, each spool segment being emptied and filled with tubing before an adjacent spool segment.

13. The system of claim 1, wherein said spool displacement device comprises means for moving the spool on the tubing supply vehicle.

14. A method for supplying flexible tubing to a well, comprising:

(a) providing (i) an injector vehicle operable to position the flexible tubing into the well, the injector vehicle having a longitudinal center axis, and (ii) a tubing supply vehicle having a longitudinal center axis and operable to provide the flexible tubing to the injector vehicle for positioning in the well, wherein the flexible tubing is mounted on at least one spool for transportation to the well, the at least one spool having an axis of rotation, wherein the longitudinal center axis of the injector vehicle is transverse to the axis of rotation of the at least one spool and transverse to the longitudinal center axis of the tubing supply vehicle, and wherein the axis of rotation of the at least one spool is substantially coplanar to the longitudinal center axis of the tubing supply vehicle;

(b) unspooling the flexible tubing from the at least one spool, wherein the unspooling step comprises the substep of displacing the spool back-and-forth along the longitudinal center axis of the tubing supply vehicle to maintain an angular orientation of the flexible tubing relative to the longitudinal center axis of the injector vehicle at an angle less than a selected angle to inhibit bending of the flexible tubing;

(c) feeding the unspooled flexible tubing to the injector vehicle; and (d) introducing the unspooled flexible tubing into the well.

15. The method of claim 14, wherein said displacing substep comprises moving the tubing supply vehicle at least once during said unspooling step.

16. The method of claim 14, further comprising the step of respooling the flexible tubing on to the at least one spool after said introducing step.

17. The method of claim 14, wherein said tubing supply vehicle comprises an axle for rotating said at least one spool.

18. The method of claim 17, wherein a roller bearing is located proximate at least a first end of said axle.

19. The method of claim 17, wherein said axle is perpendicular to the longitudinal center axis of the injector vehicle.

20. The method of claim 14, wherein said unspooling further comprises emptying a first spool segment of flexible tubing before removing flexible tubing from an adjacent second spool segment, the spool comprising a plurality of interconnected spool segments including the first and second spool segments.

21. The method of claim 14, wherein said displacing substep comprises moving the spool on the tubing supply vehicle at least once during said unspooling step.

22. A system for injecting or withdrawing a fluid into or from a well, comprising:

(a) a well operatively associated with a coil tubing injector apparatus operable to position a flexible tubing into the well;

(b) a tubing supply vehicle having a longitudinal center axis and operable to supply the flexible tubing to the injector apparatus for positioning in the well, wherein the flexible tubing is mounted on at least one spool prior to and for transportation to the well, the spool operatively associated with an axle positioned substantially in the center of said at least one spool, the at least one spool having an axis of rotation, wherein the axis of rotation and the axle are substantially parallel to the longitudinal center axis of the tubing supply vehicle, and wherein the tubing supply vehicle comprises a spool displacement device operable to displace the spool back-and-forth along the longitudinal center axis of the tubing supply vehicle to maintain an angular orientation of the flexible tubing relative to the longitudinal center axis of the injector vehicle at an angle less than a selected angle to inhibit bending of the flexible tubing.

23. The system of claim 22, wherein said flexible tubing comprises steel tubing.

24. The system of claim 22, wherein a roller bearing is located proximate at least a first end of said axle.

25. The system of claim 22, wherein the spool comprises a plurality of interconnected spool segments, each spool segment being emptied and filled with tubing before an adjacent spool segment.

26. The system of claim 22, wherein said spool displacement device comprises an internal propulsion system operatively associated with the tubing supply vehicle.

27. The system of claim 22, wherein said spool displacement device comprises means for moving the spool on the tubing supply vehicle.

* * * * *